United States Patent [19]

Livak

[11] 4,256,488

[45] Mar. 17, 1981

[54] AL-MG-SI EXTRUSION ALLOY

[75] Inventor: Ronald J. Livak, Pullman, Wash.

[73] Assignee: Swiss Aluminium Ltd., Chippis, Switzerland

[21] Appl. No.: 79,349

[22] Filed: Sep. 27, 1979

[51] Int. Cl.[3] ..... C22C 21/16

[52] U.S. Cl. ..... 75/142; 75/141; 148/32.5; 148/159

[58] Field of Search ..... 75/142, 143, 141; 148/32, 32.5, 159

[56] References Cited

U.S. PATENT DOCUMENTS 3,113,052 12/1963 Schneck ..... 148/159

*Primary Examiner*—R. Dean

*Attorney, Agent, or Firm*—Bachman and LaPointe

[57] ABSTRACT

Moderate strength extrudable dilute Al-Mg-Si aluminum base alloys are prepared comprising from 0.30 to 0.60% magnesium, from 0.45 to 0.70% silicon and from 0.10 to 0.30% copper, which may also include controlled amounts of elements such as chromium, zirconium, manganese, iron, zinc and titanium, wherein the silicon content must not exceed more than 0.30% over that needed to combine with magnesium and iron. Such alloys display lower hot flow stresses and reduced quench sensitivity as compared to AA Alloy 6063 while achieving the same strength levels.

10 Claims, No Drawings

AL-MG-SI EXTRUSION ALLOY

BACKGROUND OF THE INVENTION

The present invention relates to high strength dilute Al-Mg-Si aluminum base alloys and particularly to wrought alloys produced in extruded form wherein strength properties of AA Alloy 6063 are achieved while, at the same time, displaying lower hot flow stresses and reduced quench sensitivity when compared to AA Alloy 6063.

The relative extrudability of an alloy as indicated by permissible extrusion speed, break-out pressure and surface quality is dependent on the hot flow stresses and resistance to tearing and pick-up at extrusion temperature. The extrusion conversion cost is determined, in part, by how fast an alloy can be extruded while maintaining acceptable surface quality. Al-Mg-Si alloys are used to produce 75% of all aluminum extrusions and AA Alloy 6063 has the greatest usage within this class of alloys. It is a common commercial practice to press quench AA Alloy 6063 as the extruded shape leaves the die by employing forced air cooling. In order to obtain the desired strength properties, it is necessary for the alloy to cool through a critical temperature range in less than a certain maximum time period. When the thickness of the wall sections increases, or when extrusion speed is increased, the cooling time under the fans is insufficient to minimize the precipitation of $Mg_2Si$. An excessive precipitation of $Mg_2Si$ during cooling is detrimental because it diminishes subsequent strengthening by a precipitation hardening heat treatment. The cooling time could be reduced by slowing the extrusion rate, by adding additional cooling fans at points farther removed from the extrusion press, or by using a cooling medium like water. All of these solutions are costly or they create other problems such as distortion, water staining, or untenable working conditions. By increasing the allowable time for alloys to cool from the combined extrusion solution temperature and through the critical range (i.e. reducing their quench sensitivity) it is possible to increase extrusion speed and correspondingly decrease the extrusion cost.

Another facet of the problem is that the faster an alloy is pushed through the extrusion die, the higher its temperature rises during extrusion until it reaches a limit where the surface appearance becomes unacceptable, dimensional tolerances cannot be held, or die life is diminished. The rise in temperature is directly related to the hot flow stress of an alloy. In order to raise the rate of extrusion beyond existing limits, it is necessary to minimize the hot flow stress by judicious control of alloying elements or by metallurgical process control.

Accordingly, it is the principal object of the present invention to provide an improved high strength dilute Al-Mg-Si aluminum base alloy characterized by improved extrudability.

A further object of the present invention is to provide an aluminum alloy composition characterized by reduced quench sensitivity at high extrusion speeds.

A still further object of the present invention is to provide an alloy composition characterized by relatively low hot flow stresses.

Another object of the present invention is to provide an aluminum alloy having strength levels comparable to AA Alloy 6063.

Another further object of the present invention is to provide such alloy compositions comprising a dilute range of magnesium in conjunction with an excess of silicon and a copper addition in proportions required to achieve the desired functional characteristics.

Further objects and advantages of the present invention will be apparent from the following detailed description.

SUMMARY OF THE INVENTION

In accordance with the present invention, it has now been found that the above objects can be advantageously obtained by the provision of alloy compositions comprising from 0.30 to 0.60% magnesium, from 0.45 to 0.70% silicon and 0.10 to 0.30% copper wherein the silicon content must not exceed 0.30% silicon above that needed to combine with magnesium and iron. In a preferred embodiment, the alloys of the present invention comprise from 0.34 to 0.48% magnesium, 0.45 to 0.60% silicon and 0.14 to 0.22% copper.

In addition to the elements stated above, the alloys of the present invention may provide the following additives: iron up to 0.35%, preferably from 0.14 to 0.24%; zinc up to 0.15% and titanium up to 0.10%. In addition, chromium and zirconium should be limited to no more than 0.05% each; magnanese to no more than 0.10% and the total of these three precipitable transition elements to no more than 0.10%.

The allowable silicon level in the alloy is based on the magnesium and iron levels and should not exceed 0.3% plus 0.58 (% Mg) plus 0.25 (% Fe). If the excess silicon exceeds 0.3%, the alloy has a tendency for intergranular failure on impact loading and a reduced impact strength, due to a tendency to precipitate preferentially on the grain boundaries.

The useful range of copper to compensate for reduced $Mg_2Si$ levels, and thus strength, is more than 0.10 and up to 0.30%, preferably 0.14 to 0.22% (and ideally 0.16 to 0.18%). The useful copper additions provided increased strength so that the alloy of the present invention has strengths comparable to AA Alloy 6063.

The effective range of magnesium of from 0.30 to 0.60%, preferably 0.34 to 0.48% is such as to limit the flow stress.

It is desirable that any residual chromium be limited to 0.05% maximum and ideally that no chromium be purposefully added as chromium has an undesirable effect on quench sensitivity at cooling rates below 100° F./sec. Likewise, zirconium should be limited to 0.05% maximum and manganese limited to 0.10% maximum due to their undesirable effect on quench sensitivity.

Alloys in accordance with the present invention exhibit lower hot flow stresses and reduced quench sensitivity at high extrusion speeds while achieving strength levels of common extrusion alloy AA 6063. This represents a major advance over prior art extrusion alloys in that the speed of extrusion can be increased without changing basic equipment or handling, which results in a corresponding decrease in cost.

DETAILED DESCRIPTION

A first group of experimental alloys containing target values of 0.5–0.6% $Mg_2Si$ with 0.2–0.4% excess silicon and small amounts of copper and/or transition elements were prepared as four pound Durville castings, homogenized, scalped and hot rolled to 0.1" gage sheet. The compositions of the alloys are given in Table I. The quench sensitivity of some of the alloys was studied by varying the cooling rates from the solution temperature (970° F.) from 1000° F./sec. to 1° F./sec. and then artificially aging the samples at 350° F. for 16 hours. The resulting tensile properties of the alloys are given in Table II.

The relative quench sensitivity of an alloy of aluminum—0.5% $Mg_2Si$—0.2 excess Si (Alloy 245) as compared with additions of chromium and copper is illustrated in Table II. Chromium is shown to increase quench sensitivity (Alloy 247), as shown by the reductions in tensile strength properties. The effect of copper is shown to increase strength without substantial decrease in quench sensitivity (Alloy 250). When appearing together (Alloy 251), the effects of copper and chromium are shown to retain more or less their individual additive effects, as reflected by the relative tensile properties. In particular it can be seen that Alloy 250 achieved the highest aged yield strengths when cooled at rates of 5° F./sec. and below. Again, the yield strength of Alloy 251 indicates the detrimental effect of chromium on the quench sensitivity of the alloys. Thus, Table II clearly illustrates the positive effect of copper on strength and quench sensitivity for cooling rates below 10° F./sec. and the negative effect of chromium for the same cooling rates.

Based on these initial results, a second group of alloys was prepared to determine the composition limits for magnesium, silicon and copper and the effect of high impurity levels on the design criteria for the alloys of the present invention. The alloys were prepared as four pound Durville castings, homogenized, scalped and hot rolled to 0.2" gage sheet. The compositions of the alloys are given in Table III. An aging treatment of 8 hours at 350° F. was used on these alloys, being typical of production practices. The tensile properties measured after solution treatment, controlled cooling and artificial aging are given in Table IV.

The results given in Table IV for Alloys 288 and 291 indicate that an alloy composition of 0.45% silicon, 0.25% magnesium and 0.05% copper will not achieve the minimum tensile properties of AA Alloy 6063-T6. In order to satisfy the minimum tensile properties on a production basis, it has been found that the alloy of the present invention should have a composition from 0.30 to 0.60%, preferably 0.34 to 0.48% magnesium, from 0.45 to 0.70%, preferably 0.45 to 0.60% silicon, from 0.10 to 0.30%, preferably 0.14 to 0.22% copper, wherein the silicon content must not exceed the sum of 0.30% silicon plus 0.58 times the magnesium content plus 0.25 times the iron content. It has been found that if the excess silicon exceeds 0.30% there is a tendency for intergranular failure under impact loading. The results for Alloy 293 given in Table IV demonstrate the deleterious effect that high impurity levels have on the tensile strength of the alloy. It is preferred that the alloy comprises from 0.14 to 0.24% iron, 0.02% maximum chromium, 0.10% maximum manganese, 0.5% maximum zinc and 0.10% maximum titanium with the total of the three precipitable transition elements, chromium, zirconium and manganese, not being in excess of 0.10%.

Hot torsion tests were run on Alloy 287, an alloy within the composition range of the present invention, and a billet sample of AA Alloy 6063 containing 0.60% magnesium. The alloys were torsion tested at strain rates of 0.6 sec.$^{-1}$ and 2.0 sec.$^{-1}$ at temperatures of 700° F., 840° F. and 930° F. Alloy 287 displayed lower flow stress than the AA Alloy 6063 and the difference increased with test temperature. The test results are given in Table V. As can be seen, at a strain rate of 0.6 sec.$^{-1}$ and a temperature of 930° F., Alloy 287 had a maximum shear stress of 1135 psi vs. 1510 psi for AA Alloy 6063. The torsion test data indicates that the proposed alloy of the present invention with a lower magnesium content has improved extrudability compared to AA Alloy 6063.

Thus, as is evident from the foregoing, the alloys of the present invention display lower hot flow stresses and reduced quench sensitivity as compared to AA Alloy 6063 while achieving the same strength levels.

Unless otherwise specified, all percentages are expressed in percent by weight.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which comes within the meaning and range of equivalency are intended to be embraced therein.

TABLE I

CHEMICAL COMPOSITIONS IN WT. PCT. AND COMPOSITION PARAMETERS FOR DILUTE Al-Mg-Si ALLOYS

| Alloy | Mg | Si | Fe | Cu* | Cr** | V** | Mn** | Zr*** | Ti | Si/Mg | % $Mg_2Si$ | % Excess**** Si |
|---|---|---|---|---|---|---|---|---|---|---|---|---|
| 245 | 0.33 | 0.44 | 0.18 | — | — | — | — | — | 0.01 | 1.2 | 0.52 | 0.20 |
| 247 | 0.25 | 0.45 | 0.15 | — | 0.04 | — | — | — | 0.01 | 1.6 | 0.39 | 0.27 |
| 250 | 0.30 | 0.44 | 0.17 | 0.13 | — | — | — | — | 0.01 | 1.3 | 0.47 | 0.23 |
| 251 | 0.34 | 0.45 | 0.18 | 0.13 | 0.10 | — | — | — | 0.01 | 1.2 | 0.54 | 0.21 |

*Less than 0.02% except where noted.
**Less than 0.004% except where noted.
***Less than 0.001% except where noted.
****Based on Mg and Fe content and equation cited in text.

TABLE II

INFLUENCE OF ALLOY ELEMENTS ON QUENCH SENTIVITY
(Samples Solution Treated at 970° F., Cooled as Shown, Held at Room Temperature for 24 Hours, Aged 16 Hours at 350° F.)

| | 5° F./Sec. Cooling Rate | | | 1° F./Sec. Cooling Rate | | |
|---|---|---|---|---|---|---|
| Alloy | YS KSI | UTS KSI | EL. % | YS KSI | UTS KSI | EL. % |
| 245 - No Cu or Cr | 22.8 | 27.4 | 14.5 | 22.1 | 26.4 | 12.5 |
| 247 - 0.05 Cr | 21.6 | 26.5 | 13.7 | 19.1 | 23.9 | 13.7 |
| 250 - 0.13 Cu | 29.3 | 33.0 | 10.8 | 28.3 | 32.1 | 10.3 |
| 251 - 0.10 Cr - 0.13 Cr | 27.3 | 30.9 | 11.5 | 24.1 | 29.0 | 11.8 |

TABLE III

ALLOY COMPOSITIONS IN Wt. PCT.

| Alloy | Si | Mg | Cu | Fe | Cr | Mn | Zn | Ti |
|---|---|---|---|---|---|---|---|---|
| 286 | 0.52 | 0.32 | 0.12 | 0.20 | <0.01 | <0.02 | <0.02 | 0.01 |
| 287* | 0.56 | 0.35 | 0.13 | 0.22 | <0.01 | <0.02 | <0.02 | 0.01 |
| 288 | 0.48 | 0.23 | 0.05 | 0.19 | <0.01 | <0.02 | <0.02 | 0.01 |

TABLE III-continued

ALLOY COMPOSITIONS IN Wt. PCT.

| Alloy | Si | Mg | Cu | Fe | Cr | Mn | Zn | Ti |
|---|---|---|---|---|---|---|---|---|
| 289 | 0.50 | 0.23 | 0.20 | 0.20 | <0.01 | <0.02 | <0.02 | 0.01 |
| 290 | 0.60 | 0.47 | 0.24 | 0.19 | <0.01 | <0.02 | <0.02 | 0.01 |
| 291 | 0.48 | 0.26 | 0.05 | 0.17 | 0.05 | 0.09 | 0.16 | 0.01 |
| 292 | 0.54 | 0.27 | 0.12 | 0.22 | <0.01 | <0.02 | <0.02 | 0.01 |
| 293 | 0.48 | 0.26 | 0.04 | 0.38 | 0.05 | 0.09 | 0.16 | 0.01 |
| 6063 | 0.39 | 0.60 | <0.01 | 0.23 | <0.01 | <0.02 | <0.02 | 0.11 |

*Reserved for hot torsion testing

TABLE IV

TENSILE PROPERTIES FOR SELECTED DILUTE Al-Mg-Si ALLOYS
Solution Treated for 30 Minutes at 970° F., Cooled at Indicated Rates, Held 24 Hours at Room Temperature and Aged 8 Hours at 350° F.

| | Air Cooled 5° F./Second | | | Slack Cooled 1° F./Second | | |
|---|---|---|---|---|---|---|
| Alloy | YS KSI | UTS KSI | EL. % | YS KSI | UTS KSI | EL. % |
| 286 | 27.5 | 31.7 | 12.3 | 25.6 | 31.0 | 12.3 |
| 288 | 14.7 | 20.8 | 15.5 | 13.4 | 20.5 | 15.8 |
| 289 | 21.1 | 27.0 | 13.8 | 20.0 | 26.0 | 13.0 |
| 290 | 35.5 | 40.5 | 7.1 | 33.8 | 39.8 | 7.3 |
| 291 | 15.9 | 22.3 | 13.2 | 13.6 | 20.5 | 14.7 |
| 292 | 21.7 | 27.3 | 12.3 | 20.9 | 26.8 | 13.8 |
| 293 | 10.4 | 18.5 | 17.0 | 8.7 | 17.8 | 19.8 |
| AA6063 | 26.0 | 31.4 | 14.0 | 20.2 | 27.8 | 14.3 |
| AA6063-T6 Min. | 25.0 | 30.0 | 8.0 | | | |
| AA6063-T5 Min. | 16.0 | 22.0 | 8.0 | | | |

TABLE V

TORSION TEST DATA AA 6063 AND ALLOY NO. 287

| Test Temp., °F. | Shear Strain Rate, Sec.$^{-1}$ | AA 6063 Max. Shear Stress. psi | No. 287 Max. Shear Stress, psi |
|---|---|---|---|
| 930 | 2.0 | 1660 | 1400 |
| 930 | 0.6 | 1510 | 1135 |
| 840 | 2.0 | 2230 | 1855 |

TABLE V-continued

TORSION TEST DATA AA 6063 AND ALLOY NO. 287

| Test Temp., °F. | Shear Strain Rate, Sec.$^{-1}$ | AA 6063 Max. Shear Stress. psi | No. 287 Max. Shear Stress, psi |
|---|---|---|---|
| 840 | 2.0 | 2145 | 2030 |
| 840 | 0.6 | 1990 | 1590 |
| 840 | 0.6 | 1915 | 1650 |
| 700 | 2.0 | 3880 | 3670 |
| 700 | 2.0 | 3680 | 3670 |
| 700 | 0.6 | 3365 | 3405 |
| 700 | 0.6 | 3480 | 2990 |

What is claimed is:

1. An aluminum base dilute Al-Mg-Si extrusion alloy having a controlled excess of silicon characterized by lower hot flow stresses and reduced quench sensitivity as compared to Alloy 6063 while achieving the same strength levels of Alloy 6063 consisting essentially of 0.30 to 0.60% magnesium, 0.45 to 0.70% silicon, up to 0.35% iron, 0.14 to 0.30% copper, up to 0.05% chromium, up to 0.05% zirconium and up to 0.10% manganese wherein the silicon content does not exceed 0.30% plus the sum of 0.58 times magnesium content plus 0.25 times iron content.

2. The Alloy of claim 1 wherein the total of chromium, zirconium and manganese does not exceed 0.10%.

3. The alloy of claim 1 wherein the copper content is 0.14 to 0.22%.

4. The alloy of claim 1 wherein the magnesium content is 0.34 to 0.48%.

5. The alloy of claim 1 wherein the silicon content is 0.45 to 0.60%.

6. The alloy of claim 1 wherein the iron content is 0.14 to 0.24%.

7. The alloy of claim 1 wherein the copper content is 0.16 to 0.18%.

8. The alloy of claim 1 wherein the alloy contains 0.34 to 0.60% magnesium, 0.45 to 0.60% silicon, 0.14 to 0.24% iron and 0.14 to 0.22% copper.

9. The alloy of claim 8 wherein the total of chromium, zirconium and manganese does not exceed 0.10%.

10. The alloy of claim 1 wherein the alloy contains 0.34 to 0.60% magnesium, 0.45 to 0.60% silicon and 0.14 to 0.22% copper.

* * * * *